US006543392B1

(12) United States Patent
Ashton, III et al.

(10) Patent No.: US 6,543,392 B1
(45) Date of Patent: Apr. 8, 2003

(54) DEPLOYMENT SYSTEM FOR AN UPPER BUNDLE STEAM GENERATOR CLEANING/ INSPECTION DEVICE

(75) Inventors: Augustus J. Ashton, III, Westboro, MA (US); Steven K. Ruggieri, Marlborough, MA (US); Timothy J. Lovett, Wellesley, MA (US); Alan Brightman, Bridgewater, MA (US); Stephen Jens, Belmont, MA (US)

(73) Assignee: Foster-Miller, Inc., Waltham, MA (US)

( * ) Notice: Subject to any disclaimer, the term of this patent is extended or adjusted under 35 U.S.C. 154(b) by 0 days.

(21) Appl. No.: 08/379,646

(22) PCT Filed: Dec. 7, 1994

(86) PCT No.: PCT/US94/14371

§ 371 (c)(1),
(2), (4) Date: May 1, 1998

(87) PCT Pub. No.: WO96/17695

PCT Pub. Date: Jun. 13, 1996

(Under 37 CFR 1.47)

Related U.S. Application Data

(63) Continuation-in-part of application No. 08/239,378, filed on May 6, 1994, now Pat. No. 5,564,371.

(51) Int. Cl.[7] ..... F22B 37/52

(52) U.S. Cl. ..... 122/392; 122/379; 122/390; 134/167 R; 134/181

(58) Field of Search ..... 122/379, 390, 122/392; 134/167 R, 181; 239/73, 587.2, 587.5, 587.6, 550, 566

(56) References Cited

U.S. PATENT DOCUMENTS 338,310 A * 3/1886 Smith ..... 138/110

(List continued on next page.)

FOREIGN PATENT DOCUMENTS

| | | |
|---|---|---|
| DE | 3044788 A1 | 7/1982 |
| DE | 4226854 A | 2/1994 |

(List continued on next page.)

OTHER PUBLICATIONS

U.S. patent application Ser. No. 09/616,481, Ashton et al., filed Jul. 14, 2000.

U.S. patent application Ser. No. 09/173,570, Ashton et al., filed Oct. 15, 1998.

*Primary Examiner*—Jiping Lu

(57) ABSTRACT

A deployment system for an upper bundle steam generator cleaning/inspection device, the deployment system including an elongated body feedable through an access in a steam generator shell proximate the tube sheet of the steam generator, the elongated body flexible in one configuration to bend into a position for extension up through flow slots in support plates of the interior of the steam generator, and rigid in another configuration for positioning and supporting cleaning/inspection devices up through the steam generator proximate the upper tube bundles of the steam generator; and a drive device for driving the elongated body up through the support plates and for retracting the elongated body back down through the support plates.

33 Claims, 11 Drawing Sheets

U.S. PATENT DOCUMENTS 1,905,824 A * 4/1933 Dysthe ..... 138/120
4,231,419 A 11/1980 Gugel
4,478,546 A 10/1984 Mercer
4,498,427 A 2/1985 Todd
4,572,284 A 2/1986 Katscher et al.
4,637,588 A 1/1987 Wilhelm et al.
4,656,714 A 4/1987 Evans et al.
4,667,701 A 5/1987 Evans et al.
4,671,326 A 6/1987 Wilhelm et al.
4,676,201 A 6/1987 Lahoda et al.
4,682,630 A 7/1987 Schukei
4,690,172 A 9/1987 Everett
4,700,662 A 10/1987 Fasnacht, Jr. et al.
4,723,881 A 2/1988 Duran
4,729,423 A 3/1988 Martin
4,744,392 A 5/1988 Tade, III et al.
4,769,085 A 9/1988 Booij
4,770,235 A 9/1988 Rogers, Jr. et al.
4,826,036 A 5/1989 Lewis et al.
4,827,953 A 5/1989 Lee
4,834,069 A * 5/1989 Umeda ..... 128/4
4,860,919 A 8/1989 Weisel et al.
4,887,555 A 12/1989 Smet
4,932,441 A 6/1990 Corey et al.
4,954,312 A 9/1990 McDonald et al.
4,957,215 A 9/1990 Evans et al.
4,959,192 A 9/1990 Trundle et al.
4,989,818 A 2/1991 Trundle et al.
5,006,302 A 4/1991 Trundle et al.
5,007,460 A 4/1991 Zezza et al.
5,032,048 A 7/1991 Walton et al.
5,032,350 A 7/1991 McDonald et al.
5,036,871 A * 8/1991 Ruggieri et al. ..... 134/167 R
5,042,861 A 8/1991 Trundle et al.
5,048,570 A 9/1991 Weisel et al.
5,135,330 A 8/1992 Chen
5,164,151 A 11/1992 Shah et al.
H1115 H 12/1992 Nachbar
5,167,905 A 12/1992 Mentz et al.
5,169,594 A 12/1992 Tade, III et al.
5,171,514 A 12/1992 Veronesi et al.
5,178,129 A * 1/1993 Chikama et al. ..... 128/4
5,184,636 A 2/1993 Van Der Woude
5,205,693 A 4/1993 Fuller et al.
5,238,054 A 8/1993 Ritz et al.
5,261,600 A 11/1993 Cradeur
5,265,129 A 11/1993 Brooks et al.
5,286,154 A 2/1994 Jens et al.
5,292,074 A * 3/1994 Clark et al. ..... 239/546
5,305,713 A 4/1994 Vadakin
5,341,406 A 8/1994 Jens et al.
5,348,234 A 9/1994 v. d. Woude
5,411,043 A * 5/1995 Kamler ..... 134/167 R
5,564,371 A 10/1996 Ashton et al.
5,570,660 A 11/1996 Vandenberg
5,615,734 A 4/1997 Hyp
5,638,415 A 6/1997 Nafziger et al.
5,782,209 A * 7/1998 Vandenberg ..... 122/379
5,913,320 A 6/1999 Varrin, Jr. et al.

FOREIGN PATENT DOCUMENTS

JP 53-21303 2/1978
JP 58-224218 12/1983
JP 59-500065 1/1984
JP 61-130798 A 6/1986
JP 61-130799 6/1986
JP 62-33299 2/1987
JP 62-45535 3/1987
JP 62-74730 4/1987
JP 62-87720 4/1987
JP 62-123100 4/1987
JP 63-182394 7/1988
JP 62-241692 3/1989
JP 63-93587 10/1989
JP 5-52592 3/1993
JP 58-132339 9/1993
JP 6-201085 7/1994
JP 06-320473 8/1995
JP 09-026107 1/1997
JP 7-528916 9/1997
WO WO 90/09850 9/1990

* cited by examiner

DEPLOYMENT SYSTEM FOR AN UPPER BUNDLE STEAM GENERATOR CLEANING/ INSPECTION DEVICE

RELATED APPLICATIONS

This application is a Continuation-in-Part of U.S. application Ser. No. 08/239,378 filed May 6, 1994 now U.S. Pat. No. 5,564,371.

FIELD OF INVENTION

This invention relates to a deployment system for an upper bundle cleaning/inspection device for a nuclear power plant steam generator.

BACKGROUND OF INVENTION

Steam generators convert heat from the primary side of a nuclear power plant to steam on the secondary side so that the primary and secondary systems are kept separate. A typical generator is a vertical cylinder consisting of a large number of U-shaped tubes which extend upward from the floor or "tube sheet" of the generator. Fluid at high temperature and pressure from the reactor travels through the tubes giving up energy to a feed water blanket surrounding the tubes in the generator creating steam and ultimately power when the stream is introduced to turbines.

Steam generators were designed to last upwards of forty years but in practice such reliability figures have proven not to be the case. The problem is that sludge from particulate impurities suspended in the feed water forms on the tubes which greatly affects the efficiency of the generator and can even cause the tubes to degrade to the point of causing fissures in the tubes. If radioactive primary fluid within the tubes seeps into the secondary side, the result can be disastrous. Plugging or otherwise servicing such fissures is time consuming and results in expensive down time during which power must be purchased from other sources at great expense.

There are known methods for cleaning the tubes proximate the bottom of the steam generator using flexible lances and the like using water under pressure, but since a typical steam generator can be thirty feet tall, it is very difficult to reach the sludge at the upper levels of the tubes using water jets directed upwards from the bottom of the generator.

So, chemical cleaning is used but there are several disadvantages. First, chemical cleaning is very expensive and requires an extended outage. Also, the solvents used in chemical cleaning can corrode the internal components of the steam generator. In addition, chemical cleaning can generate large quantities of hazardous, possibly radioactive waste. Disposal of this waste is very expensive. For these reasons, although many utilities have considered chemical cleaning, few plants have actually implemented it.

On the other hand, there are severe technical challenges faced when considering alternate cleaning methods. A typical steam generator has approximately 50,000 square feet of heat transfer area. The tube bundle is about 10 feet in diameter and 30 feet tall but the access alley in the middle of the tube bundle is only 3.5 inches wide and is interrupted by a series of successive support plates approximately every 4 feet. There are flow slots through the support plates but they are very small in size, typically 2.75 by 15 inches. In addition, the access into the steam generator is limited to a six inch hand hole. Finally, the gap between the vertically extending tubes is only 0.406 or less.

Therefore, manipulating cleaning spray heads and/or inspection equipment up 30 feet to the top of the steam generator to clean or inspect the upper tube bundles is not trivial. There are three primary design considerations. First, the deployment system must be small enough so it can fit through the hand hole of the steam generator and through the flow slots in successive support plates. Second, the deployment system must extend up through the flow slots to a length of as much as 30 feet while still providing support for the cleaning head or inspection device deployed at the distal end. Third, the deployment system must be fully retractable. A system which has the potential for failure, which could become lodged in the upper regions of the tube bundles, or which could fail and leave components inside the steam generator is too risky to employ inside the very expensive steam generators.

In addition, the deployment system must facilitate fast cleaning and/or inspection to minimize downtime with a minimum of manual labor due to the expensive outage costs associated with nuclear power plants and the potential hazard of radioactive exposure to workers in the area during cleaning.

In the patent to Brooks (U.S. Pat. No. 5,265,129), a dual boom design is discussed wherein a telescoping portion consisting of a plurality of pneumatic or hydraulic cylinders is used to deploy an inspection camera up through the support plates. One problem with this design is that the telescoping portion in its collapsed state must be received through the hand hole of the generator and then uprighted—but it cannot exceed the height of the first tube support plate which may be as small as 18 inches.

Such a device which in its collapsed state can be uprighted in an 18 inch height and which is still capable of extending up to 30 feet is difficult to design, manufacture, and control.

SUMMARY OF INVENTION

It is therefore an object of this invention to provide a deployment system for an upper bundle steam generator cleaning/inspection device which does not rely on telescoping cylinders.

It is a further object of this invention to provide such a deployment system which allows cleaning of the steam generator to proceed from the top down thereby flushing deposits downward during the cleaning process.

It is a further object of this invention to provide such a deployment system which eliminates the need to use chemical cleaning techniques and overcomes the disadvantages inherent in chemical cleaning or which can be used in conjunction with chemical cleaning.

It is a further object of this invention to provide such a deployment system which fits through an access in the bottom of the steam generator, which can be protracted to extend up through the flow slots in the support plates of the interior of the steam generator to deliver a cleaning head or inspection camera to the upper bundles of the steam generator, and which then retracts back down through the flow slots for removal after the cleaning and/or inspection operation is completed.

This invention results from the realization that instead of inserting a device into the steam generator through the hand hole and then relying on telescoping cylinders to deploy a cleaning head or inspection camera up through the tube support plates, a suitable deployment system can instead be constructed by using a snake-like device which is fed through the hand hole from the outside of the steam generator, is flexible enough to make the 90° turn to be in position to travel upwards through the tube support plates, and is also rigid enough to then travel upwards to the upper tube bundles of the steam generator (e.g., 30 feet) and still support inspection devices or cleaning heads for inspection or cleaning the upper areas of the steam generator, and which is also retractable so that the inspection device or cleaning heads are safely removed from within the steam generator.

This invention features a deployment system for an upper bundle steam generator cleaning/inspection device. The deployment system may suitably comprise, include, consist essentially of, or consist of an elongated body feedable through an access in a steam generator shell proximate the tube sheet of the steam generator. The elongated body is flexible in one configuration to bend into a position for extension up through flow slots in support plates of the interior of the steam generator and rigid in another configuration for positioning and supporting cleaning/inspection devices up through the steam generator proximate the upper tube bundles of the steam generator. There are also some means for driving the elongated body up through the support plates and for retracting the elongated body back down through the support plates.

The elongated body assembly typically includes means for mounting a cleaning head on a terminal end thereof for cleaning the upper tube bundles of the steam generator and/or means for mounting an inspection camera on a terminal end thereof for inspecting the upper tube bundles of the steam generator.

The elongated body may be a rigid chain, or a pair of rigid chains each bendable in only one direction, each deployed into the steam generator by bending, the pair deployed back to back in the rigid configuration.

Another type of rigid chain includes a number of links, each pivotable with respect to an adjacent link in one configuration, the links including means for releasably locking adjacent links against pivoting in another configuration. The means for releasably locking includes retractable pins for locking the links together when engaged, and for freeing said links when retracted. In this case, the means for driving includes means for automatically retracting and engaging the pins.

The means for releasably locking may alternatively include detent balls on one portion of the links and complementary detent recesses on one portion of adjacent sets of links or, the means for releasably locking may include a spring for urging one link to remain engaged with an adjacent link. The means for releasably locking may be a magnet for urging one link to remain engaged with an adjacent link. Also, the means for releasably locking may be both a spring and a magnet for urging one link to remain engaged with an adjacent link. The rigid chain could also be a plurality of links each having a hinge and a portion extending beyond the hinge for preventing movement of an adjacent link in one direction.

As an alternative to the rigid chain configuration, the elongated body may include a plurality of rigid links. The links each have a hinge and at least one articulation recess proximate the hinge for allowing movement of an adjacent link in only one direction, or there may be an articulation recess on each side of the hinge. The deployment system may also be an extendable mast formed of a material self-biased to form a tube. In this case, the means for driving includes a pair of counter-rotating drums for driving the mast material engaged between the drums.

The mast configuration and the rigid chain configuration or the rigid link configuration may be combined: the elongated body comprises a rigid chain supported by an extendable mast formed of a material self-biased to form a tube or the elongated body comprises a series of rigid links supported by a mast formed of a material self-biased to form a tube.

The drive means preferably includes a turning shoe for directing the elongated body from a position proximate the tube sheet to a position for extension upwards therefrom to the upper bundles of the steam generator.

DISCLOSURE OF PREFERRED EMBODIMENT

Other objects, features and advantages will occur to those skilled in the art from the following description of a preferred embodiment and the accompanying drawings, in which.

Figure 1:
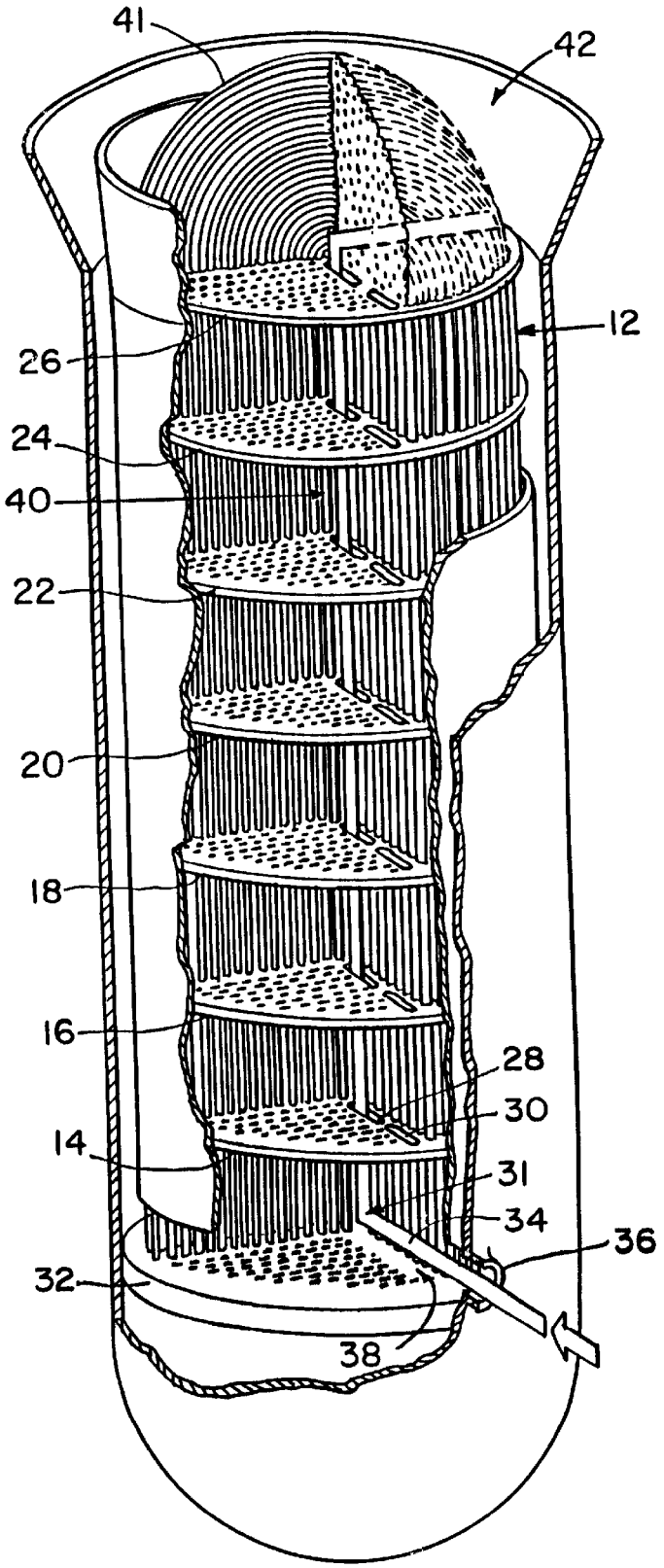
FIG. 1 is a schematic view of a typical steam generator.

FIG. 1 schematically shows steam generator 10 which includes heat transfer tubes 12 separated into sections by successive tube support plates 12, 14, 16 18, 22, 24, and 26. Each tube support plate includes a number of flow slots 28 and 39 as shown for first tube support plate 12.

The Westinghouse model W44 and W51 steam generators comprise the largest steam generator market segment and the dimensions of the W51 are similar to the W44. The W44 steam generator utilizes 116" diameter tube support plates spaced evenly at 51" above the tube sheet. There are two 6" diameter hand holes such as hand hole 36 at each end of the 3½" blowdown lane 38 at the tube sheet 32 level. Each tube sheet support plate has three flow slots measuring 2¾" by 15" spaced at 4" inches on each side of center tie rod 40. The flow slots are aligned with respect to each other so that there is a clear "line of sight" vertical passage from the blow down lane 38 to the U-bends 41 of the tubes above the top tube support plate 26.

As discussed in the Background of the Invention above, there are known instruments for water-spray cleaning the areas between tube sheet 32 and first tube sheet support plate 14 at the bottom of the steam generator but the very close confines within the upper bundles of the steam generator make cleaning the tubes near the upper support plates very difficult. See, e.g., U.S. Pat. No. 5,265,129.

In this invention, it was realized that there is an access path 34 from hand hole 36 along blowdown lane 38 to the center tie rod 40 and then upwards through the aligned flow slots 28, 30, etc. in each support plate to the top portion 42 of the steam generator. And, it was realized that if a cleaning head or heads could be deployed to the top portion 42 of the steam generator, the generator could be cleaned from the top down thereby flushing deposits downward during the cleaning process. The technical challenge is to design a cleaning or inspection head deployment system which will fit within the close confines of the interior of the steam generator, which is flexible enough to make the 90° turn shown at 31, which is rigid enough to then travel upwards to the upper bundles 42 of the steam generator to support inspection devices or cleaning heads for inspection or cleaning, and which is also retractable so that the inspection or cleaning heads are safely removed for which the steam generator.

Figure 2:
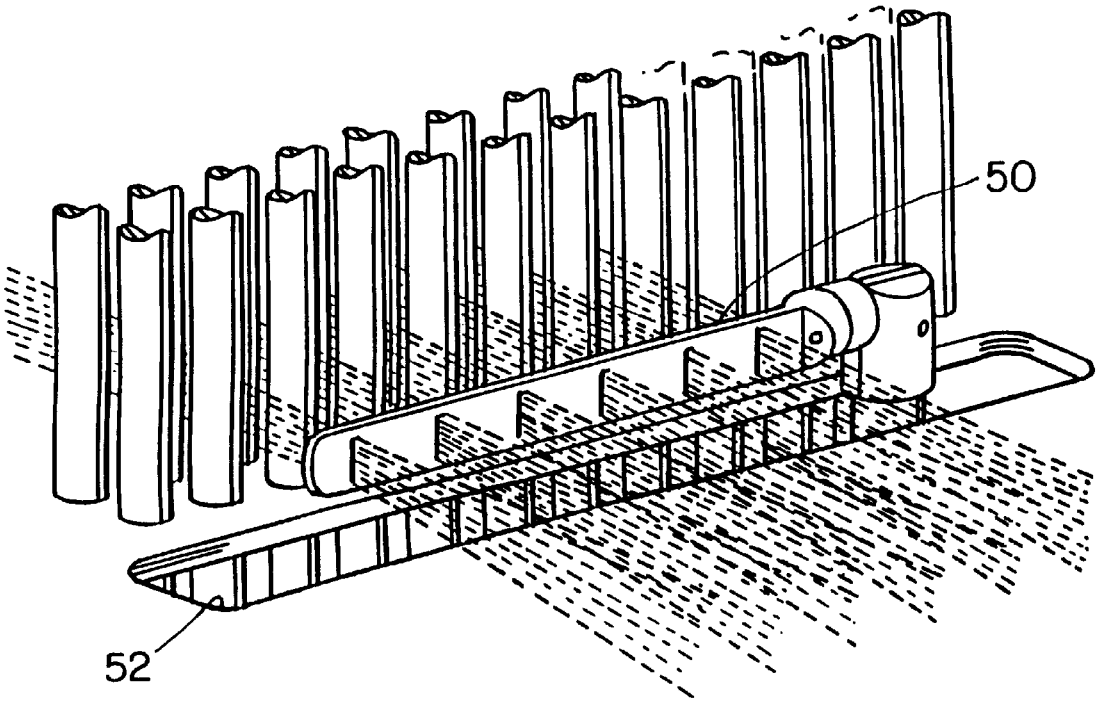
FIG. 2 is a schematic diagram of one type of cleaning head raised into position by the deployment system of this invention.
Figure 3:
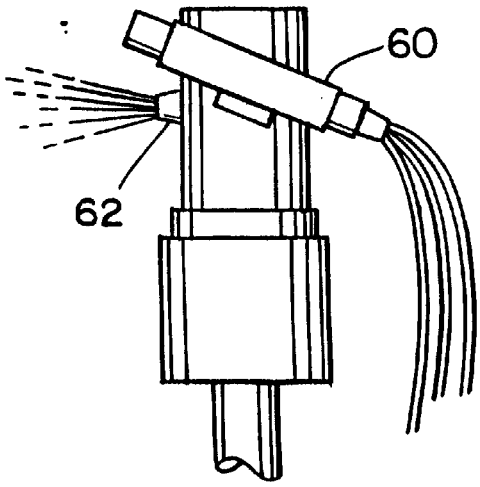
FIG. 3 is a schematic diagram of a combined cleaning head and inspection device raised into position by the deployment system of this invention.

FIG. 2 shows an example of one type of cleaning head 50 designed to spray water from flow slot 52 about a support plate in the upper reaches of the steam generator. FIG. 3 shows a combined inspection/cleaning device including video camera 60 and nozzle 62 which may also be deployed up through the flow slots in the support plates.

Figure 4:
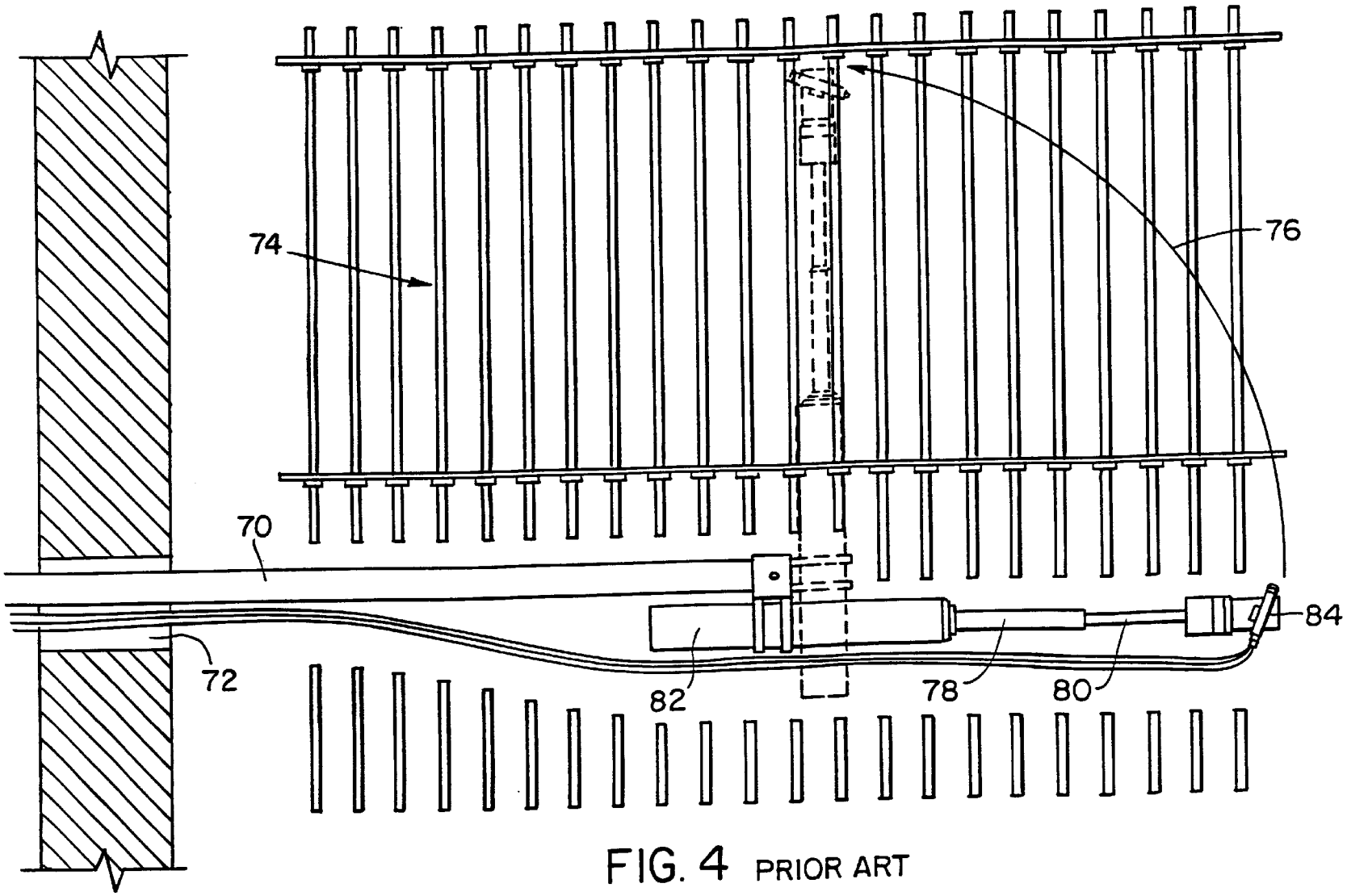
FIG. 4 PRIOR ART
FIG. 4 is a schematic diagram of a deployment system according to the prior art which uses a series of telescopic cylinders.

The prior art deployment system for such a combined inspection/cleaning device is shown in FIG. 4. Boom 70 is extended through access port 72 and then uprighted within blowdown lane 74 as shown by arrow 76. Telescoping members 78, 80 extend from within cylinder 82 and deploy inspection camera 84 upward. See U.S. Pat. No. 5,265,129.

As explained in the Background of Invention above, however, the distance between tube sheet 32, FIG. 1 and the first support plate 12 can be only 18 inches. A device such as the boom and telescoping. cylinders combination which in its collapsed state is only 18 inches tall and which must still extend up to 30 feet is difficult to design, manufacture, and control. Moreover, this design requires that the boom 70 be placed inside the steam generator.

Figure 5:
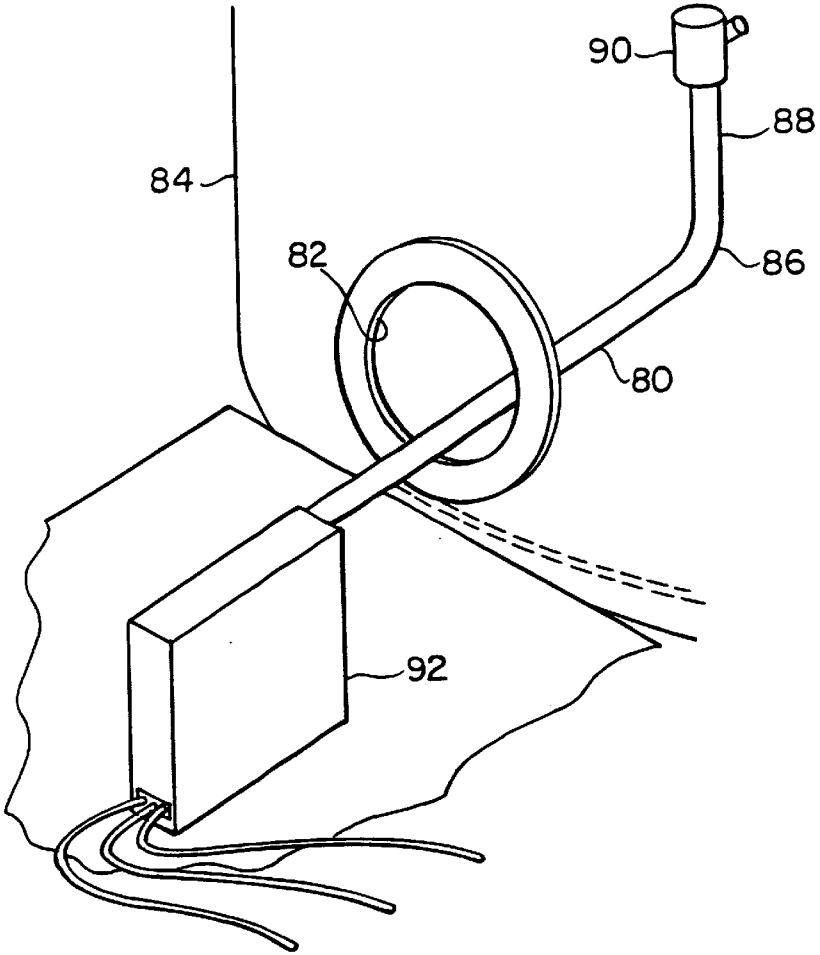
FIG. 5 is a schematic view of the deployment system of this invention which employs an elongated body flexible in one configuration and fairly rigid in another configuration.

In contrast, the invention of this application includes an elongated body 80, FIG. 5 feedable through hand hole 82 from outside steam generator 84. Elongated body 80 is flexible enough to bend into position to travel upwards as shown at 86 and also rigid in another configuration as shown at 88 for positioning cleaning head/inspection device 90 (see FIGS. 2 and 3) up through the steam generator to reach the upper tube bundles.

There are some means 92 for driving elongated body 80 up through support plates 12, 14, 16, 18, 22, 24, and 26, FIG. 1, and for retracting body 80, FIG. 5, back down through the support plates.

Figure 6:
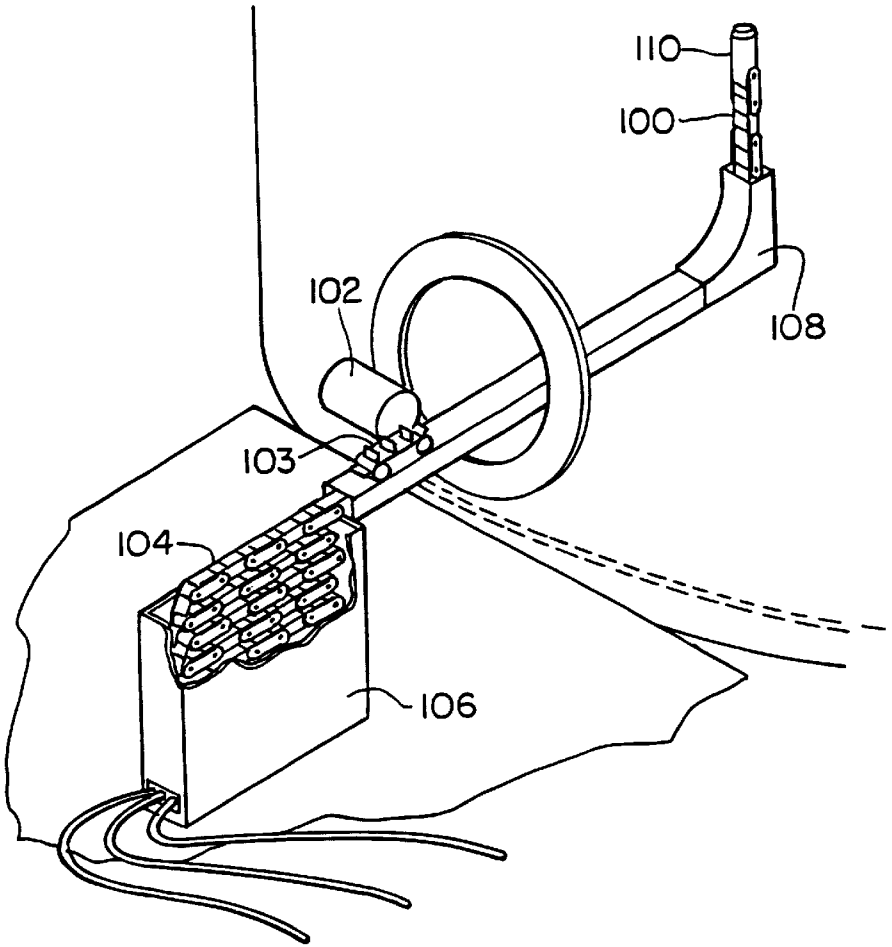
FIG. 6 is a schematic view of a rigid chain embodiment of the elongated body shown in FIG. 5.

In a preferred embodiment, elongated body 80, FIG. 5, is a "rigid chain" 100, FIG. 6 driven by motor 102 and drive assembly 103 as it unfurls from stack 104 in container 106. Turn shoe 108 directs rigid chain 100 to turn upwards carrying inspection/cleaning head 110 to the upper two bundles of the steam generator. Rigid chain 100 is flexible enough to make the bend shown at 109 but is also rigid enough to extend upwards after bend 108 and support cleaning and inspection equipment about the upper tube bundles some 30 feet from bend 108.

Other elongated bodies, however, are possible and are within the scope of this invention so long as they are flexible in one configuration to bend into a position for extension up through the flow slots and rigid in another configuration for positioning and supporting cleaning head/inspection devices up through the flow slots in the support plates of the steam generator. The various embodiments are discussed as follows.

Rigid Chains

Figure 7:
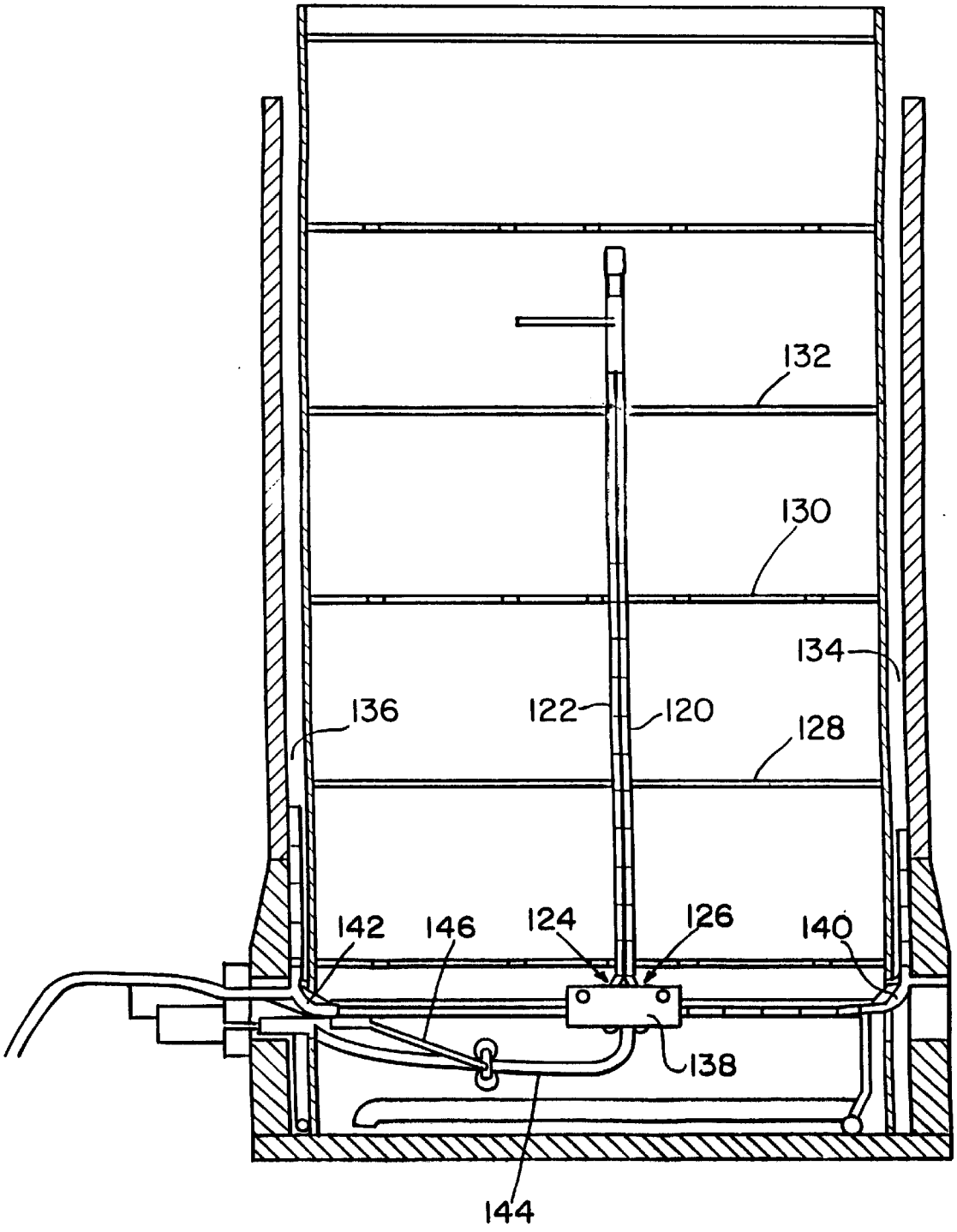
FIG. 7 is a schematic view an embodiment including back to back rigid chains according to this invention.

In one embodiment, there are two rigid chains 120 and 122, FIG. 7. Rigid chain 122 is constructed to bend in only one direction as shown in 124 while rigid chain 120 is constructed to bend only in the opposite direction as shown at 126. When placed back-to-back, the combination is rigid enough to be deployed upward supporting a cleaning head/inspection device up through the flow slots in the tube support plates 128, 130, 132, etc. Rigid chain 120 is deployed first in annulus 134 while rigid chain 122 is deployed first in annulus 136. Then, both chains are driven by drive 138 through guide shoes 140 and 142 respectively. Video/cleaning fluid umbilical 144 is tensioned by tension arm 146.

Figure 10:
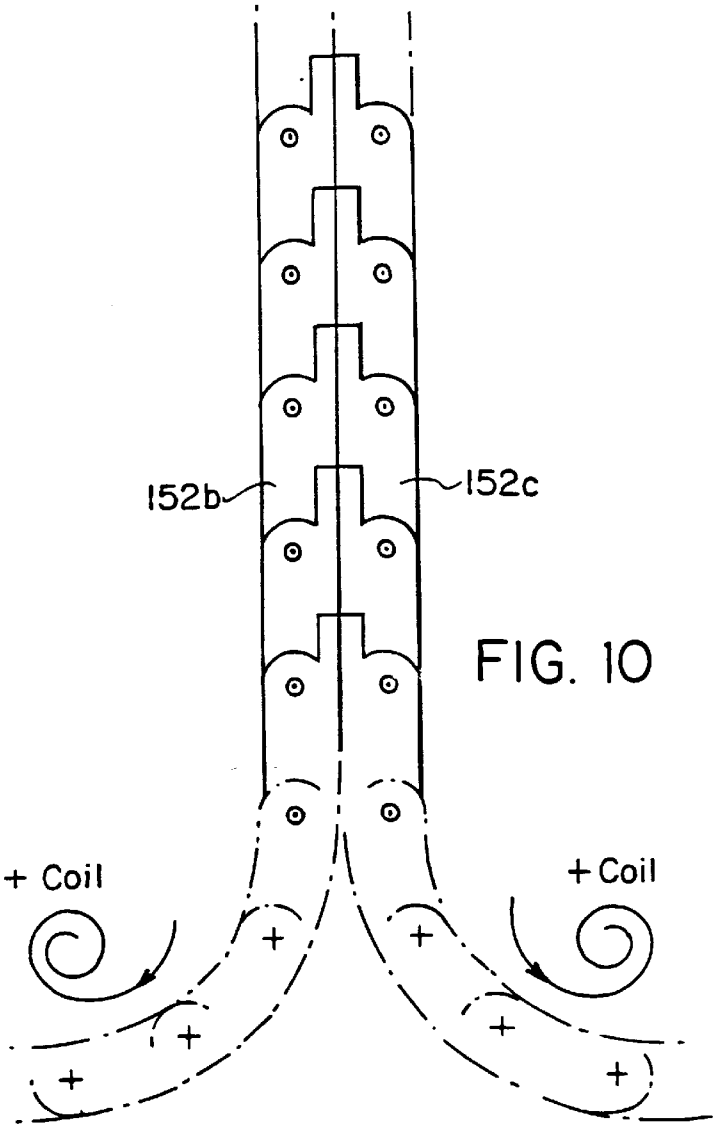
FIG. 10 is a front view of two rigid chains placed back to back in the deployment system of this invention.
Figure 9:
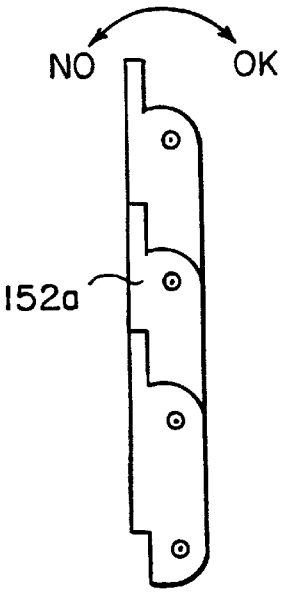
FIG. 9 is a front view of a rigid chain used in the deployment system of this invention.
Figure 8:
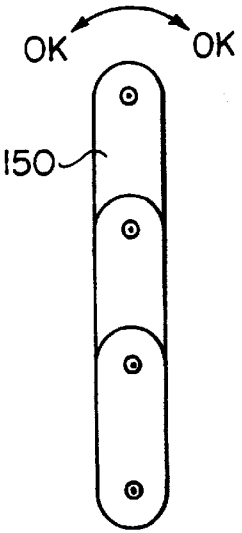
FIG. 8 is a front view of a typical chain linkage.

As shown in FIG. 8, a typical non-rigid chain 150 is free to bend in two directions. Rigid chain 152*a*, FIG. 9, however, is free to bend in only one direction. When two such chains 152*b* and 152*c*, FIG. 10, are placed back to back, a rigid structure is formed from an assembly flexible in one configuration—namely, each chain by itself.

Figure 11A:
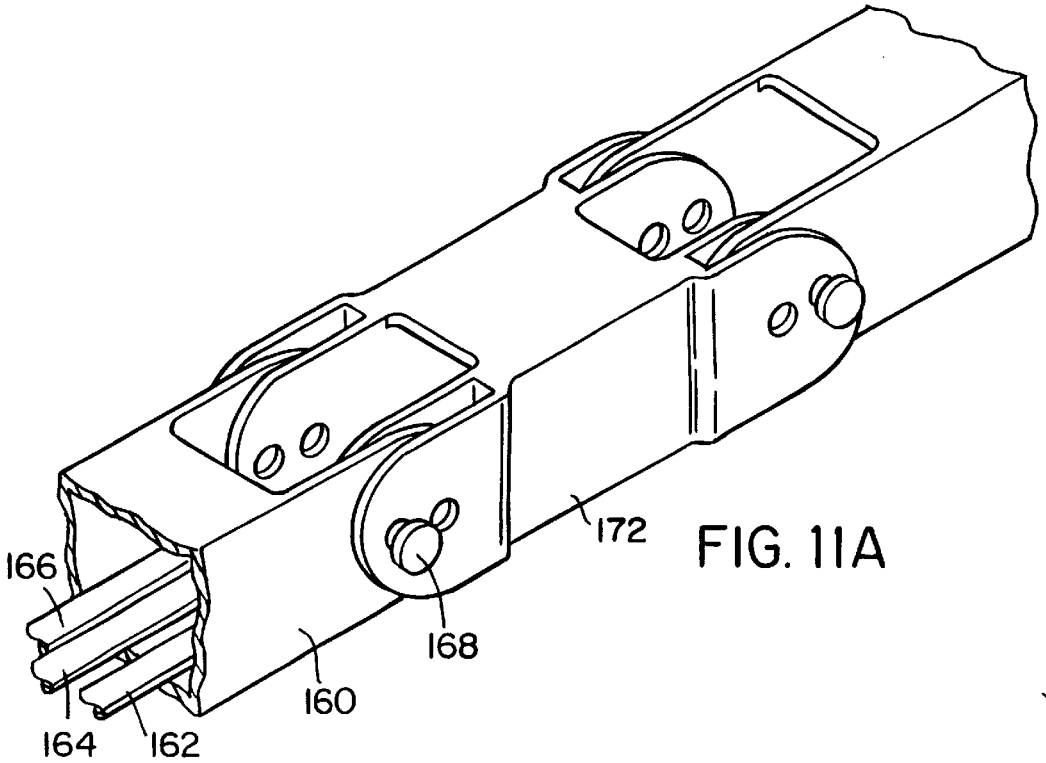
FIGS. 11A and 11B are schematic views of another type of rigid chain used in the deployment system of this invention.

Another rigid chain is shown in FIG. 11A. Each link 160 is hollow to carry video 162, cleaning spray 164, and power 166 umbilicals. Pin 168 engages the adjacent link to prevent rotation of the links with respect to each other. Pin 168 also retracts to allow bending of link 172 with respect to link 160.

Figure 11B:
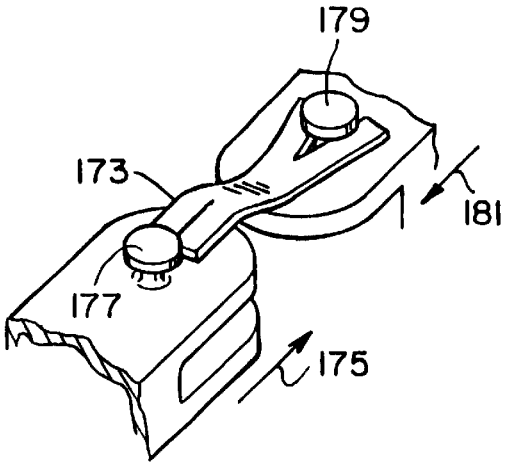

In this embodiment, a pin drive 173, FIG. 11B is used to push the engagement pins in after the 90° turn is made providing a rigid support. The pin drive also pulls the engagement pins out upon retraction of the rigid chain back down through the flow slots of the support plates of the steam generator. Pin drive 177 can be as simple as a set of leaf type springs that bear against the top of the pin 177, engaging it in the hole, when pushed from the direction shown by arrow 175. When pin 179 is pulled back, in the direction shown by arrow 181, the leaf springs bear under the pin head, disengaging it from the hole in the links.

Figure 12:
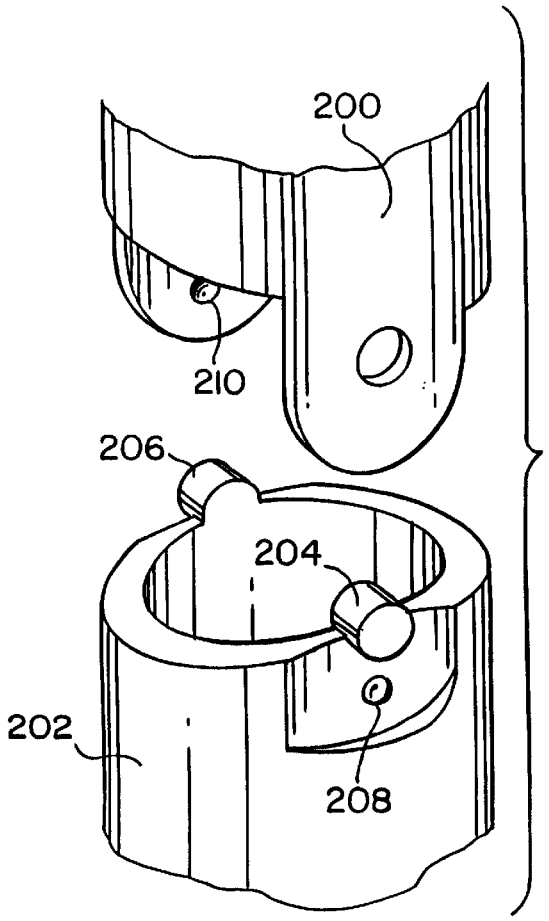
FIG. 12 is a schematic view of still another type of rigid chain used in the deployment system of this invention.

In another embodiment, the rigid chain concept includes link 200, FIG. 12, joined to link 202 by pins 204 and 206. Detent ball 208 on link 202 engages a detent recess 210 on link 200. In this way, link 202 is normally locked with respect to link 200 but upon the application of a sufficient bending force (by pushing the chain through turn shoe 108, FIG. 6) detent ball 208 will be dislodged from detent recess 210 thereby allowing link 200 to pivot with respect to link 202 providing a flexible configuration to bend into a position for extension up through the flow slots in the support plates of the interior of the steam generator. After the bend is made, the detent balls of one link again engage the detent recesses of an adjacent link to provide a rigid configuration for positioning and supporting inspection/cleaning devices up through the steam generator proximate the upper tube bundles.

The design shown in FIG. 12 offers advantages over the paired rigid chain design shown in FIG. 7 in that only one set of links is required and also offers advantages over the pin configuration shown in FIG. 11 since a pin engagement/retraction drive is not required. Also, in the configuration shown in FIG. 12, the hollow interior of links 200 and 202 provide a passage for the umbilical subsystem.

Figure 13:
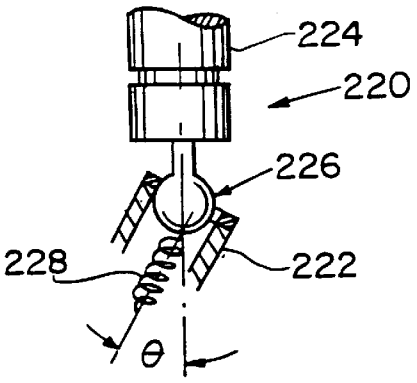
FIG. 13 is a schematic view of a spring biased rigid chain according to this invention.

In another embodiment, rigid chain 220, FIG. 13 includes links 222 and 224 joined by ball and spring assembly 226. Spring 228 biases link 224 to lock with respect to link 222 but upon the application of sufficient bending force (by pushing the chain through turn shoe 108, FIG. 6), the links can rotate with respect to each other to make the 90° turn shown at 86, FIG. 5. The closest analogy to this embodiment is a series of tent poles engaged by an elastic "bungie" cord running though the center of the poles. After the 90° turn is made, the springs bias the links together providing a rigid configuration for deployment up through the steam generator.

Figure 15:
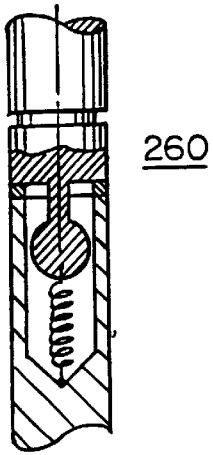
FIG. 15 is a schematic view of a rigid chain incorporating both a magnet and a spring.
Figure 14:
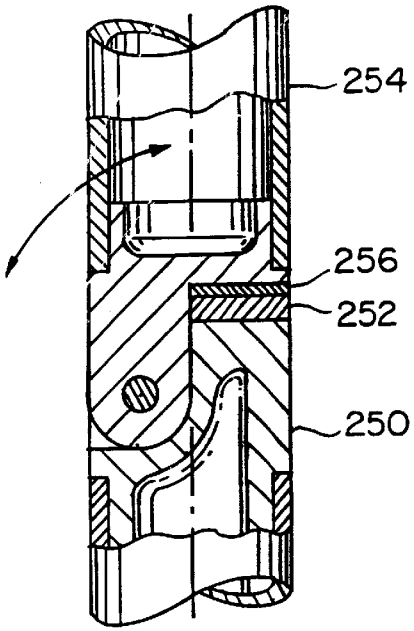
FIG. 14 is a schematic view of a magnetically biased rigid chain according to this invention.

In another embodiment, link 250, FIG. 14 includes rare earth magnet 252 while link 254 includes ferrous plate 256. The magnet 252 of link 250 is attracted to ferrous plate 256 of link 254 thereby urging the links to remain locked together. A sufficient bending force, however, as with the designs shown in FIGS. 12 and 13, will allow the links to rotate with respect to each other but will then engage again after bending of the chain. Rigid chain 260, FIG. 15, is a combination of both the spring embodiment shown in FIG. 13 and the magnet embodiment shown in FIG. 14.

Figure 16:
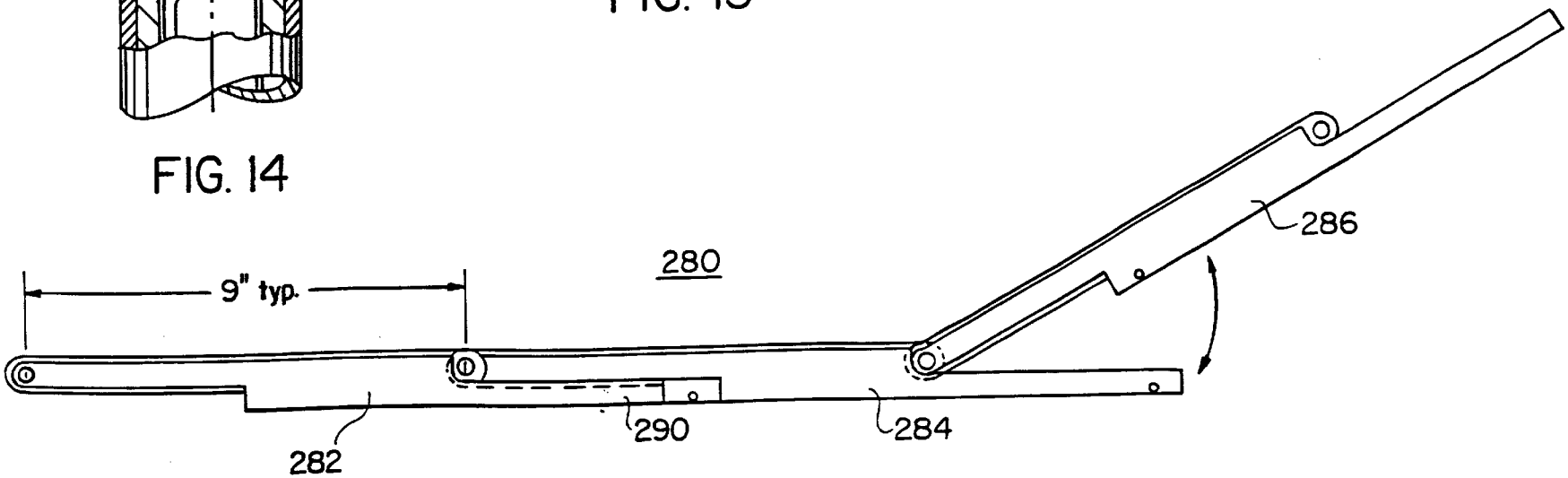
FIG. 16 is a front view of another type of rigid chain according to this invention.

In another embodiment, rigid chain 280, FIG. 16, includes fairly lengthy links 282, 284, and 286 each having an extension 290 as shown for link 282 which prevents each adjacent link from rotating in one direction. These longer links minimize the total number of links required for the system.

Rigid Links

Figure 17:
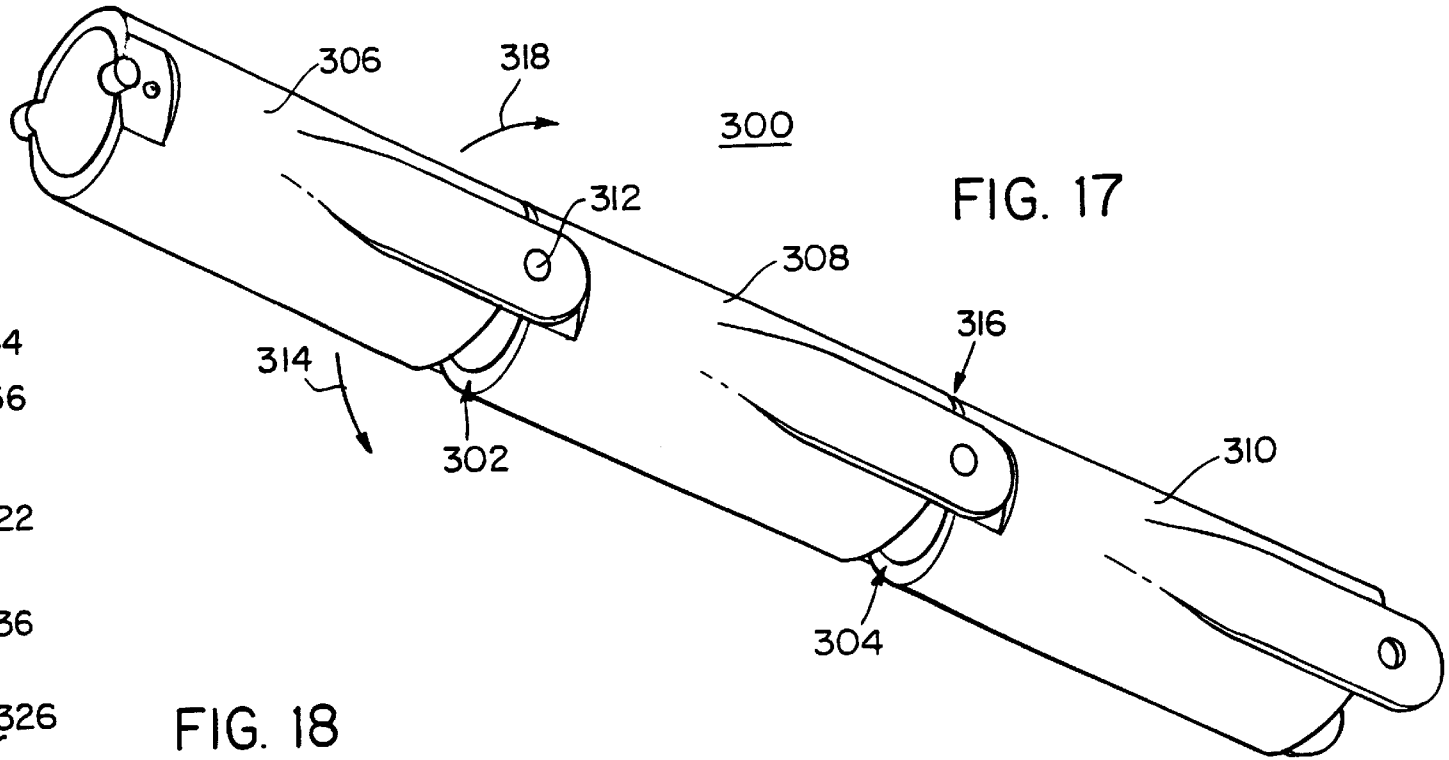
FIG. 17 is a schematic view of a series of rigid links with a single articulation recess according to this invention.

Another embodiment for elongated body 80, FIG. 5 which is flexible in one configuration and rigid in another configuration is a series of rigid links, FIG. 17. Hollow rigid links 306, 308, 310 each include articulation recesses 302 and 304 between adjacent links 306, 308, and 310. In this embodiment, the articulation recess is only on one side of each link. Pivot pin 312 and articulation recess 302 allow link 306 to rotate slightly with respect to link 308 in the direction shown by arrow 314. Since each link can rotate slightly, the series of rigid links can make the bend required to traverse the blowdown lane of the steam generator (See FIG. 1) but then also extend upward through the flow slots and in this configuration the assembly is fairly rigid since "backbone" portion 316 prevents the individual links from bending in the direction shown by arrow 318.

Figure 18:
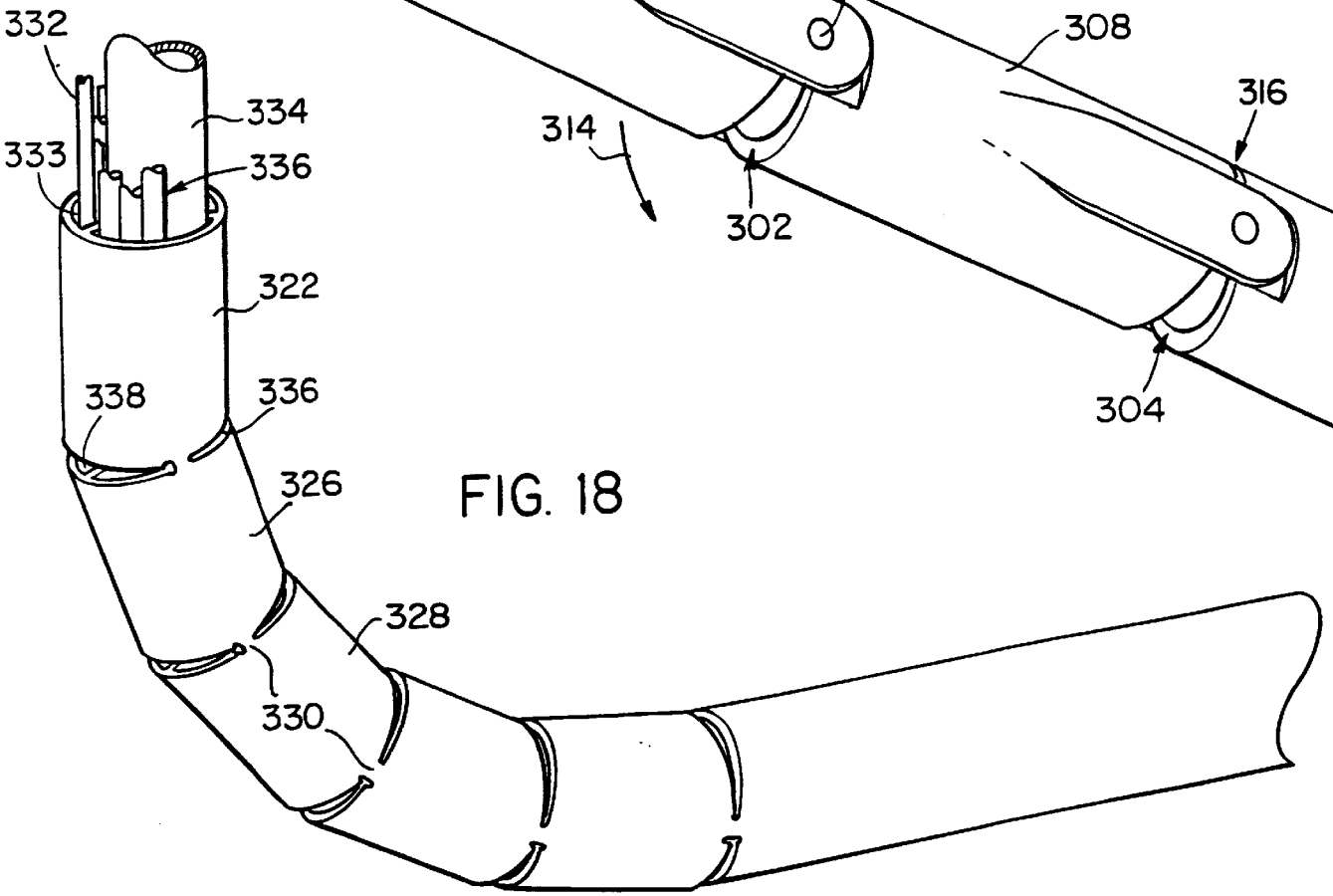
FIG. 18 is a schematic view of a series of rigid links having dual articulation recesses according to this invention.

A similar design is shown in FIG. 18 for rigid links 322, 326 and 328. In this case, each link 322, 324, and 326 comprises a hollow member joined to an adjacent link by elastomeric hinge element 330. Here, there is an articulation recess 336 and 338 on each side of each elastomeric hinge element. The series of links can bend enough to be driven down the blowdown lane and then turn upwards to extend up through the flow slots. Straightening cable 332 which passes through orifice 333 formed in each link is used to lock the links in a rigid configuration. Water umbilical 334 and peripheral service lines 336 pass through the center of each link. These links may be made of any flexible plastic material.

Mast Embodiments

An alternative to the various rigid chain or rigid link embodiments described above is shown in FIG. 19. Extendable mast 360 is made of a material normally self-biased to form a tube as shown at 362 even though it can be fed off a flat roll 364. The material of mast 360 is typically a 0.010 spring-tempered stainless steel available from Spar Aerospace 9445 Airport Road, Brampton, Ontario, Canada. The natural aspect of the material is a 2" diameter tube with plenty of overlap. The tube may be reinforced along its length by guide sleeves such as sleeve 364 as required.

Figure 20:
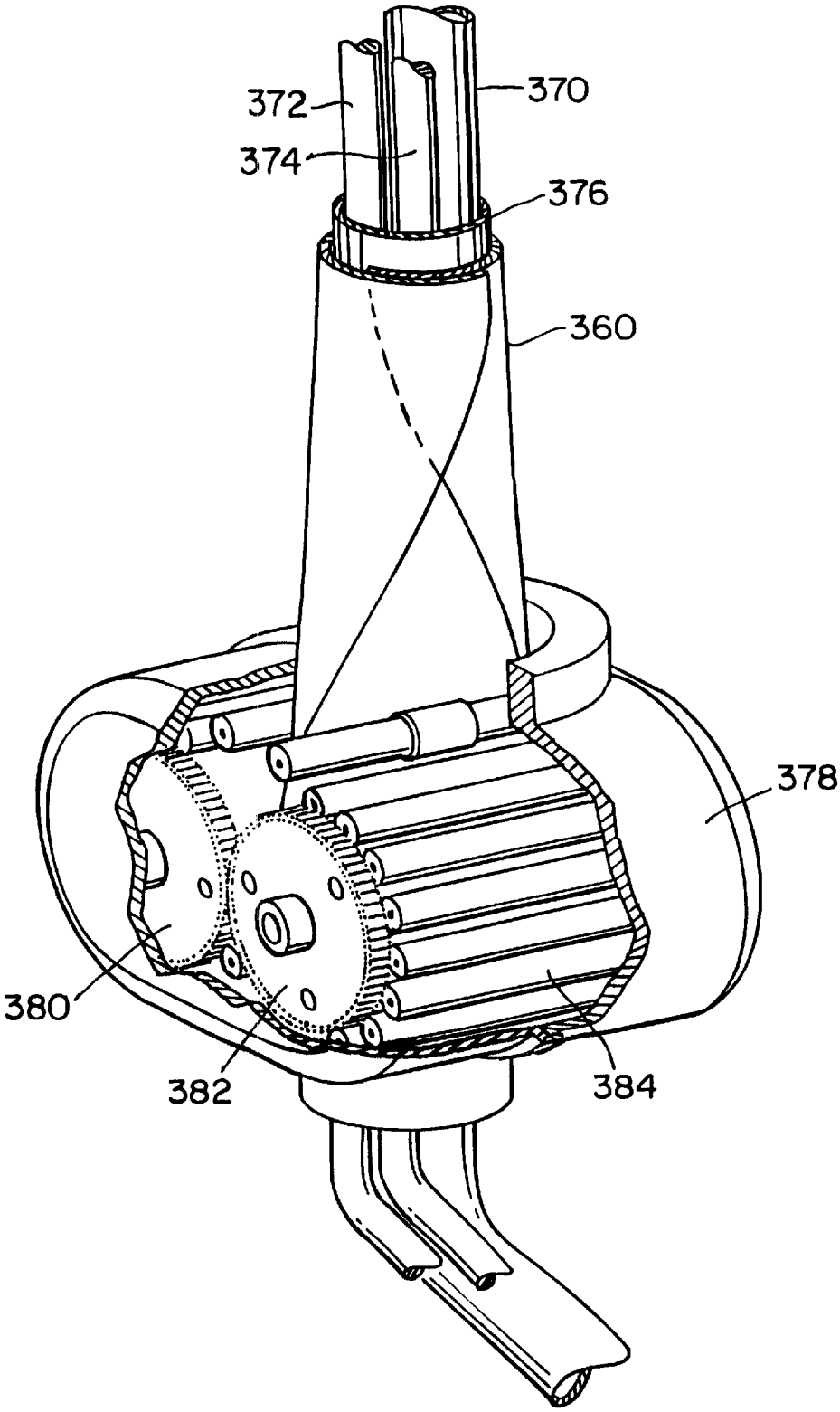
FIG. 20 is another view of the self-biased mast of this invention including drive means.

As shown in FIG. 20, mast 360 guides water line 370 and peripheral service lines 372 and 374 encased by jacketing material 376 up through the flow slots of the steam generator. Motor drive 378 drives this embodiment of the deployment system up through the flow slots. Motor drive 378 includes counter rotating drums 380 and 382 each driving planetary guide roller arrangement 384. As an alternative, two rolls of the mast material may be used to form a tube—each roll forming half of the tube with plenty of overlap for extra rigidity.

Combined Mast/Rigid Link Embodiments

Figure 21:
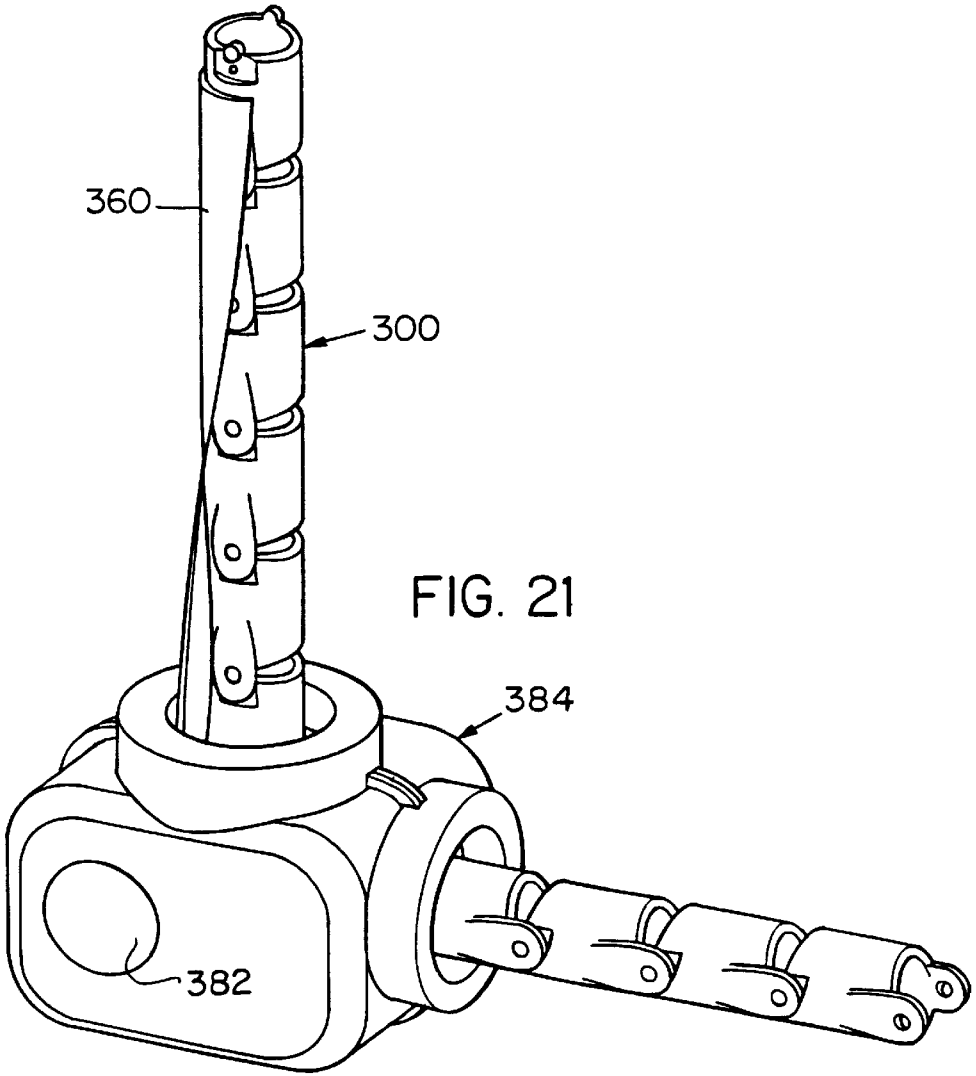
FIG. 21 is a schematic view of a deployment system according to this invention which employs both a mast material and a rigid link structure.
Figure 19:
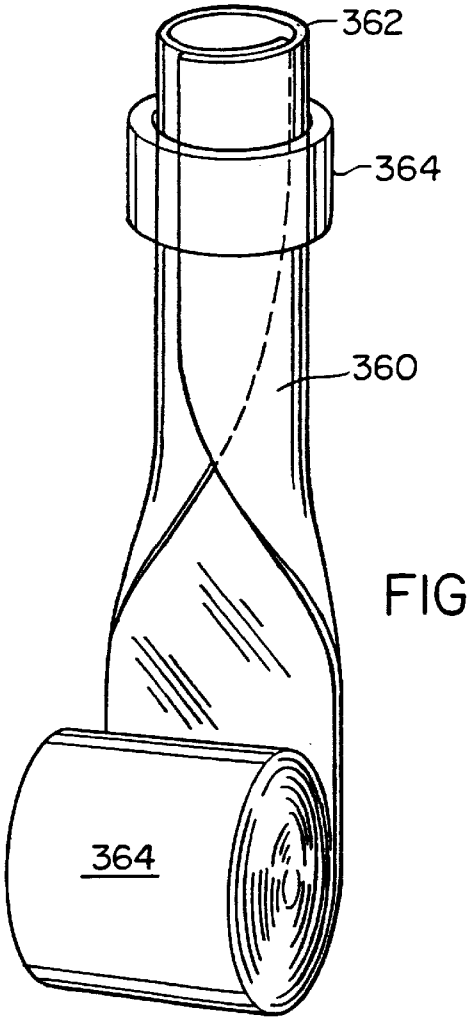
FIG. 19 is a schematic view of a self-biased mast used in the deployment system according to this invention.

The mast shown in FIGS. 19–20 may used in conjunction with any of the rigid chains or rigid links described above including the rigid link embodiment 300, FIG. 17 as shown in FIG. 21 for additional support as the rigid links are extended upward to the top of the steam generator. Mast storage drum 382, FIG. 21 includes the roll or rolls of mast material and turning shoe 384 feeds the rigid links from outside the hand hole of the steam generator and ultimately up through the flow slots in the successive series of support plates.

In any embodiment of the elongated snake-like body of this invention, whether rigid chain or rigid link embodiments or the mast material embodiment, or combinations thereof, the boom and telescopic cylinders of the prior art shown in FIG. 4 are eliminated and instead the elongated body is small enough so that it can be fed through the hand hole of the steam generator and through the flow slots in successive support plates. The body is also fully retractable to prevent any risk of any component of the system from becoming lodged in the upper regions of the steam generator. The body is flexible enough in one configuration to bend into a position for extension up through the flow slots in successive support plates and rigid in another configuration for positioning and support cleaning head/inspection devices up about the upper tube bundles.

Accordingly, the instant invention in any embodiment achieves the seemingly mutually exclusive goal of providing a deployment device which can bend and which is also rigid enough after the bend to support a cleaning head or an inspection device at a distance up to 30 feet within the steam generator.

Therefore, although specific features of this invention are shown in some drawings and not others, this is for convenience only as each feature may be combined with any or all of the other features in accordance with the invention.

And, other embodiments will occur to those skilled in the art and are within the following claims:

1. A deployment system for an upper bundle steam generator cleaning/inspection device, said deployment system comprising:

an elongated body feedable substantially horizontally through a lower access in a steam generator shell proximate the tube sheet of the steam generator, said elongated body flexible in one configuration to bend into a position for extension vertically up through flow slots in support plates of the interior of the steam generator, and being structured and arranged to be rigid and not bend in any direction when vertically disposed for positioning and supporting cleaning/inspection devices up through the steam generator proximate the upper tube bundles of the steam generator;

means for guiding the elongated body to bend from said substantially horizontal orientation to the rigid vertical position; and means for driving said elongated body vertically up through said support plates and for retracting said elongated body back down through said support plates.

2. The deployment system of claim 1 in which said elongated body assembly includes means for mounting a cleaning head on a terminal end thereof for cleaning the upper tube bundles of the steam generator.

3. The deployment system of claim 1 in which said elongated body includes means for mounting an inspection camera on a terminal end thereof for inspecting the upper tube bundles of the steam generator.

4. The deployment system of claim 1 in which said elongated body is a rigid chain.

5. The deployment system of claim 4 in which said rigid chain includes a number of links, each pivotable with respect to an adjacent link in one configuration, said links including means for releasably locking adjacent links against pivoting in another configuration.

6. The deployment system of claim 5 in which said means for releasably locking includes retractable pins for locking said links together when engaged, and for freeing said links when retracted.

7. The deployment system of claim 6 in which said means for driving includes means for automatically retracting and engaging said pins.

8. The deployment system of claim 5 in which said means for releasably locking includes detent balls on one portion of said links and complementary detent recesses on one portion of adjacent sets of links.

9. The deployment system of claim 5 in which said means for releasably locking includes a spring for urging one link to remain engaged with an adjacent link.

10. The deployment system of claim 5 in which said means for releasably locking includes a magnet for urging one link to remain engaged with an adjacent link.

11. The deployment system of claim 5 in which said means for releasably locking includes both a spring and a magnet for urging one link to remain engaged with an adjacent link.

12. The deployment system of claim 4 in which said rigid chain includes a plurality of links each having a hinge and a portion extending beyond said hinge for preventing movement of an adjacent link in one direction.

13. The deployment system of claim 1 in which said elongated body comprises a pair of rigid chains, each bendable in only one direction, each deployed into the steam generator by bending, the pair deployed back to back in the rigid configuration.

14. The deployment system of claim 1 in which said elongated body comprises a pair of rigid chains, each chain free to bend in one direction but rigid in the opposite direction.

15. The deployment system of claim 13 further including means for orientating said pair of rigid chains back to back thereby providing a rigid structure for positioning and supporting cleaning/inspection devices up through the steam generator.

16. The deployment system of claim 1 in which said elongated body includes a plurality of rigid links.

17. The deployment system of claim 16 in which said links each have a hinge and at least one articulation recess proximate said hinge for allowing movement of an adjacent link in only one direction.

18. The deployment system of claim 17 in which said links includes an articulation recess on each side of said hinge.

19. The deployment system of claim 1 in which said elongated body includes an extendable mast formed of a material self-biased to form a tube.

20. The deployment system of claim 19 in which said means for driving includes a pair of counter-rotating drums for driving said mast material engaged between said drums.

21. The deployment of system of claim 1 in which said elongated body comprises a rigid chain supported by an extendable mast formed of a material self-biased to form a tube.

22. The deployment system of claim 1 in which said elongated body comprises a series of rigid links supported by a mast formed of a material self-biased to form a tube.

23. The deployment system of claim 1 in which said drive means includes a turning shoe for directing said elongated body from a position proximate the tube sheet to a position for extension upwards therefrom to the upper bundles of the steam generator.

24. A deployment system for an upper bundle steam generator cleaning/inspection device, said deployment system comprising:

first and second rigid chains including a number of links, each pivotable with respect to an adjacent link when in a non-vertical configuration for bending into a position for travel up through the interior of the steam generator, said first and second rigid chains being structured and arranged when combined to not bend in any direction when vertically disposed; and means for releasably locking adjacent links against pivoting when in the vertical configuration for positioning and supporting cleaning/inspection devices up through the interior of the steam generator.

25. The deployment system of claim 24 in which said means for releasably locking includes retractable pins for locking said links together when engaged, and for freeing said links when retracted.

26. The deployment system of claim 24 in which said means for releasably locking includes detent balls on one portion of said links and complementary detent recesses on one portion of adjacent sets of links.

27. The deployment system of claim 24 in which said means for releasably locking includes a spring for urging one link to remain engaged with an adjacent link.

28. The deployment system of claim 24 in which said means for releasably locking includes a magnet for urging one link to remain engaged with an adjacent link.

29. The deployment system of claim 24 in which said means for releasably locking includes both a spring and a magnet for urging one link to remain engaged with an adjacent link.

30. A system for inspecting or cleaning the upper bundles of a steam generator, the system comprising:

a deployment system including an elongated body feedable substantially horizontally through a lower access in a steam generator shell proximate the tube sheet of the steam generator, said elongated body flexible in one configuration to bend into a position for extension vertically up through the flow slots in support plates of the interior of the steam generator and structured and arranged to be rigid and not bend in any direction when vertically disposed for positioning and supporting cleaning/inspection devices up through the steam generator proximate the upper tube bundles of the steam generator;

a head attached to a distal end of the elongated body which extends substantially horizontally from the distal end of the elongated body when the elongated body is extended vertically and the distal end thereof is proximate the upper tube bundles of the steam generator;

means for guiding the elongated body to bend from the substantially horizontal orientation to the rigid vertical position; and means for driving said elongated body vertically up through said support plates and also for retracting said elongated body back down through said support plates.

31. A system for inspecting or cleaning the upper bundles of a steam generator, the system comprising:

a deployment system including an elongated body feedable substantially horizontally through a lower access in a steam generator shell proximate the tube sheet of the steam generator, said elongated body flexible in one configuration to bend into a position for extension vertically up through the flow slots in support plates of the interior of the steam generator and structured and arranged to be rigid and not bend in any direction when vertically disposed for positioning and supporting cleaning/inspection devices up through the steam generator proximate the upper tube bundles of the steam generator, a head attached to a distal end of the elongated body which extends substantially horizontally from the distal end of the elongated body when the elongated body is extended vertically and the distal end thereof is proximate the upper tube bundles of the steam generator; and means for driving said elongated body vertically up through said support plates and also for retracting said elongated body back down through said support plates.

32. A system for inspecting or cleaning the upper bundles of a steam generator, the system comprising:

a deployment system including an elongated body feedable substantially horizontally through a lower access in a steam generator shell proximate the tube sheet of the steam generator, said elongated body flexible in one configuration to bend into a position for extension vertically up through the flow slots in support plates of the interior of the steam generator and structured and arranged to be rigid and not bend in any direction when vertically disposed for positioning and supporting cleaning/inspection devices up through the steam generator proximate the upper tube bundles of the steam generator;

a head attached to a distal end of the elongated body which extends substantially horizontally from the distal end of the elongated body when the elongated body is extended vertically and the distal end thereof is proximate the upper tube bundles of the steam generator; and means for guiding the elongated body to bend from the substantially horizontal orientation to the rigid vertical position.

33. A deployment system for an upper bundle steam generator cleaning/inspection device, said deployment system comprising:

a first rigid chain free to bend in only one direction and including a number of links, each pivotable with respect to an adjacent link when in a non-vertical configuration for bending into a position for travel up through the interior of the steam generator; and a second rigid chain free to bend only in a direction opposite the first rigid chain and including a number of links, each pivotable with respect to an adjacent link when in a non-vertical configuration for bending into a position for travel up through the interior of the steam generator;

wherein the first and second rigid chains are placed back-to-back to form a rigid structure when vertically disposed for positioning and supporting cleaning/inspection devices up through the interior of the steam generator.

* * * * *

Disclaimer

6,543,392 B1 — Ashton, III et al., Westboro, MA (US). DEPLOYMENT SYSTEM FOR AN UPPER BUNDLE STEAM GENERATOR CLEANING/INSPECTION DEVICE. Patent dated Apr. 8, 2003, Disclaimer filed June 26, 2004, by the Assignee, Foster-Miller, Inc.

This patent is subject to a terminal disclaimer.

(*Official Gazette June 14, 2005*)